US009093255B2

(12) United States Patent
Weed et al.

(10) Patent No.: US 9,093,255 B2
(45) Date of Patent: Jul. 28, 2015

(54) ARRAY STRUCTURES FOR FIELD-ASSISTED POSITRON MODERATION AND CORRESPONDING METHODS

(76) Inventors: Ryan Weed, Port Angeles, WA (US); Joshua Machacek, Lincoln, NE (US)

( * ) Notice: Subject to any disclaimer, the term of this patent is extended or adjusted under 35 U.S.C. 154(b) by 40 days.

(21) Appl. No.: 14/125,868

(22) PCT Filed: Jun. 12, 2012

(86) PCT No.: PCT/US2012/042049

§ 371 (c)(1), (2), (4) Date: Mar. 7, 2014

(87) PCT Pub. No.: WO2012/173989

PCT Pub. Date: Dec. 20, 2012

(65) Prior Publication Data

US 2014/0184061 A1 Jul. 3, 2014

(30) Foreign Application Priority Data

Jun. 13, 2011 (AU) ..... 2011100705

(51) Int. Cl.

*H01J 23/00* (2006.01)
*H01J 43/14* (2006.01)
*G21K 1/00* (2006.01)

(52) U.S. Cl.

CPC .. *H01J 43/14* (2013.01); *G21K 1/00* (2013.01)

(58) Field of Classification Search

USPC ..... 315/500, 501, 505, 507
See application file for complete search history.

(56) References Cited

U.S. PATENT DOCUMENTS 3,390,293 A * 6/1968 Nunan ..... 313/363.1
4,392,111 A * 7/1983 Rostoker ..... 315/504
5,821,705 A * 10/1998 Caporaso et al. ..... 315/507

OTHER PUBLICATIONS

Brandes, G. R., et al.; "*Diamond Field-Assisted Moderator*;" Materials Science Forum, vols. 255-257; pp. 635-655; dated 1997.
Jacobsen, F. M., et al.; "*Electric-field-assisted moderator for generation of intense low-energy positron beams*;" Physical Review B, vol. 57, No. 12; pp. 6998-7003; dated Mar. 15, 1998.
Liszkay, L., et al.; "*Improved tungsten moderator structures for slow positron beams*;" Applied Surface Science, vol. 194; pp. 16-19; dated 2002.
International Preliminary Report for Application No. PCT/US2012/042049; dated Dec. 17, 2013.
International Search Report and Written Opinion for Application No. PCT/US2012/042049; dated Feb. 6, 2013.

* cited by examiner

*Primary Examiner* — Thuy Vinh Tran
(74) *Attorney, Agent, or Firm* — Alston & Bird LLP

(57) ABSTRACT

Apparatuses and methods for the moderation of positrons are provided herein. The apparatus includes a structure consisting of linear arrays of electrode and semiconductor structures of generally planar or cylindrical form with vacuum gaps between each element electrode. This structure may be contained within a vacuum chamber. The positron source is positioned adjacent to the moderator structure or the electrodes may act as the positron source by pair production through bombardment of high energy photons, electrons, or neutrons. Positrons from this source are implanted into the moderator material and drift to the moderator surfaces through the influence of the electric fields produced by the electrodes. Positrons are emitted from the surfaces of the moderator material and are confined by orthogonal electric and magnetic fields while they drift out from the vacuum gap between cathodes and anodes for extraction.

24 Claims, 15 Drawing Sheets

ARRAY STRUCTURES FOR FIELD-ASSISTED POSITRON MODERATION AND CORRESPONDING METHODS

FIELD OF THE INVENTION

This invention relates to the field of positron moderation in general and more specifically to methods and apparatus for high-efficiency moderation of positrons from high-energy sources, such as linear accelerators (LINAC), gamma-ray sources, or nuclear reactor-based sources.

BACKGROUND OF THE INVENTION

Positrons are the anti-particle of an electron, each having the same mass as an electron, but opposite charge. When a positron and electron combine, they annihilate, converting 100% of their mass into energy. Positrons are currently used in a wide range of applications including medicine, fundamental physics research, and materials characterization. High intensity positron sources may be critical in the creation of the world's first gamma-ray laser. Antimatter has the highest energy density of any known substance, and positrons have been studied by NASA as a possible propellant for high performance in-space propulsion systems.

Currently, the most intense source of positrons in the world produces $10^9$ cold positrons per second. At this production rate, it would take over 10 million years to accumulate a milligram of positrons. In order to realize these newer concepts, a much more intense source of positrons must be developed.

SUMMARY OF THE INVENTION

In order to solve the problem of producing a significant quantity of positrons, there is a need to find new ways to moderate positrons with large energies (>1 MeV).

As such, an objective of embodiments of the present invention is to develop new methods for moderation of hot positrons that enable production of positrons at rates several orders of magnitude larger than current methods. In an example embodiment, an apparatus for moderation of positrons may comprise an array of electrodes (cathodes and anodes) in a planar, quadruple, or octopole arrangement. The apparatus may also provide an electric field for FAM. Cathodes may be coated with a wide-band-gap-semiconductor (WBGS) material or other material that supports FAM, with a vacuum gap between the cathode and anode. Such an electrode arrangement eliminates the need for surface deposited electrodes and is scalable to higher positron energies by increasing the number of layers (planar geometry) or electrode elements (quadrupole or octopole geometry).

The goal of such example apparatuses is to provide a sufficiently high electric field in the moderator material to attain field assisted moderation (FAM). In addition, the overall cumulative moderator material thickness may be large enough to ensure that a large fraction of incident positrons will thermalize in the structure, while at the same time, each individual element of the structure should be thin enough to allow positrons to drift to the surface before annihilating with an electron.

In one example embodiment, an apparatus for moderation of positrons is provided. The apparatus comprises a vacuum chamber and at least one cathode structure positioned within the vacuum chamber. The apparatus further comprises a moderator material attached to at least a portion of the at least one cathode structure. The moderator material is configured to receive positrons from a positron source. The apparatus further comprises at least one anode positioned within the vacuum chamber and spaced apart from the at least one cathode structure and moderator material so as to define a vacuum gap between the moderator material and the at least one anode. The apparatus further comprises a voltage source connected to the at least one cathode structure and the at least one anode. The voltage source is configured to apply a positive potential to the at least one cathode structure and a negative potential to the at least one anode to create an electric field that is configured to cause the positrons received by the moderator material to drift toward the surface of the moderator material and into the vacuum gap.

In some embodiments, the apparatus may further comprise a magnetic field source configured to produce a magnetic field throughout the at least one cathode structure and the at least one anode. The magnetic field may be perpendicular to the electric field and configured to cooperate with the electric field to encourage the positrons to drift through the vacuum gap toward a harvesting area.

In some embodiments, the apparatus may further comprise an electron source. The positron source may comprise a converter positioned within the vacuum chamber proximate the at least one cathode structure. The electron source may be configured to emit electrons toward the converter, and the converter may be configured to produce positrons upon collision of the electrons with the converter.

In some embodiments, the apparatus may further comprise a neutron source configured to emit neutrons toward the at least one cathode structure. The at least one cathode structure may be configured to emit gamma-rays upon capture of the neutrons by the at least one cathode structure. The at least one anode may be configured to produce positrons upon collision of the gamma-rays with the at least one anode such that the at least one anode acts as the positron source.

In some embodiments, the at least one cathode structure may comprise at least two cathode structures and the at least one anode may comprise at least two anodes. The at least two cathode structures and the at least two anodes may be positioned along a plane so as to form a planar array.

In some embodiments, the at least one cathode structure may define a cylindrical shape. The at least one anode may comprise four anodes spaced radially from the at least one cathode structure and each of the anodes may define a cylindrical shape.

In some embodiments, the at least one cathode structure may define a cylindrical shape. The at least one anode may comprise eight anodes spaced radially from the at least one cathode structure and each of the anodes may define a cylindrical shape.

In some embodiments, the at least one cathode structure may comprise a cathode and an insulator material positioned between the moderator material and the cathode. The insulator material may be configured to increase electrical resistance between the cathode and the moderator material.

In yet another example embodiment, an apparatus for moderation of positrons is provided. The apparatus comprises a vacuum chamber and at least one cathode structure positioned within the vacuum chamber. The apparatus further comprises a moderator material attached to at least a portion of the at least one cathode structure. The moderator material is configured to receive positrons from a positron source. The apparatus further comprises at least one anode positioned within the vacuum chamber. The apparatus further comprises a voltage source connected to the at least one cathode structure and the at least one anode. The voltage source is configured to apply a positive potential to the at least one cathode structure and a negative potential to the at least one anode to create an electric field that is configured to cause the positrons received by the moderator material to drift toward the surface of the moderator material. The apparatus further comprises a magnetic field source configured to produce a magnetic field throughout the at least one cathode structure and the at least one anode. The magnetic field is perpendicular to the electric field and configured to cooperate with the electric field to encourage the positrons to drift toward a harvesting area.

In yet another embodiment, a method for moderation of positrons is provided. The method comprises providing an apparatus comprising a vacuum chamber and at least one cathode structure positioned within the vacuum chamber. The apparatus further comprises a moderator material attached to at least a portion of the at least one cathode structure. The moderator material is configured to receive positrons from a positron source. The apparatus further comprises at least one anode positioned within the vacuum chamber and spaced apart from the at least one cathode structure and moderator material so as to define a vacuum gap between the moderator material and the at least one anode. The apparatus further comprises a voltage source connected to the at least one cathode structure and the at least one anode. The method further comprises establishing an electric field across the apparatus by applying a positive potential to the at least one cathode structure and applying a negative potential to the at least one anode. The electric field is configured to cause the positrons received by the moderator material to drift toward the surface of the moderator material and into the vacuum gap. The method further comprises extracting the positrons that drift away from the moderator material through the vacuum gap.

In some embodiments, the method may further comprise establishing a magnetic field across throughout the at least one cathode structure and the at least one anode. The magnetic field may be perpendicular to the electric field and configured to cooperate with the electric field to encourage the positrons to drift through the vacuum gap toward a harvesting area.

In some embodiments, the method may further comprise causing emission of electrons toward the positron source. The positron source may comprise a converter positioned within the vacuum chamber proximate the at least one cathode structure. The converter may be configured to produce positrons upon collision of the electrons with the converter.

In some embodiments, the method may further comprise causing emission of neutrons toward the at least one cathode structure. The at least one cathode structure may be configured to emit gamma-rays upon capture of the neutrons by the at least one cathode structure. The at least one anode may be configured to produce positrons upon collision of the gamma-rays with the at least one anode such that the anode acts as the positron source.

In yet another embodiment, a method for moderation of positrons is provided. The method comprises providing an apparatus comprising a vacuum chamber and at least one cathode structure positioned within the vacuum chamber. The apparatus further comprises a moderator material attached to at least a portion of the at least one cathode structure. The moderator material is configured to receive positrons from a positron source. The apparatus further comprises at least one anode positioned within the vacuum chamber and a voltage source connected to the at least one cathode structure and the at least one anode. The method further comprises establishing an electric field across the apparatus by applying a positive potential to the at least one cathode structure and applying a negative potential to the at least one anode. The electric field is configured to cause the positrons received by the moderator material to drift toward the surface of the moderator material. The method further comprises establishing a magnetic field throughout the at least one cathode structure and the at least one anode. The magnetic field is perpendicular to the electric field and is configured to cooperate with the electric field to encourage the positrons to drift toward a harvesting area. The method further comprises extracting the positrons from the harvesting area.

In another embodiment, an apparatus for moderation of positrons is provided. The apparatus comprises an array of cathode structures of planar or cylindrical geometry which are coated with a thin electrically insulating material and moderator material on both sides and placed within a vacuum chamber. The apparatus further comprises an array of solid or mesh anodes of planar or cylindrical geometry placed within the vacuum chamber and adjacent to and electrically isolated from each cathode structure. The apparatus further comprises a voltage source electrically connected to each electrode (e.g., cathode and anode). The voltage source is capable of delivering a positive potential to each cathode and a negative potential to each anode. The apparatus further comprises a magnet positioned adjacent or exterior to said cathode and anodes so that at least a portion of said cathode and anode is contained within a magnetic field. The apparatus further comprises a vacuum gap between each cathode structure and anode element, whereby an electric field produced by said voltage source exists with a direction perpendicular to said magnetic field.

In some embodiments, the cathode material may comprise a positron source. In some embodiments, the apparatus may further comprise a positron source located adjacent to said cathode and anodes.

In some embodiments, the cathode and anodes may be made of material suited for pair production of positrons (e.g., platinum, tungsten, etc.) and the moderator may be made of wide band gap semiconductor material (e.g., silicon carbide, gallium arsenide, gallium nitride, diamond, etc.) suitable for high velocity drift in the presence of an electric field.

In some embodiments, a method using the apparatus may be provided. The method may comprise producing positrons via a pair-production process by collisions of high energy photons, electrons, or neutrons with atoms in said cathode and anode material.

In some embodiments, the method may further comprise establishing an electric field between the cathodes and anodes to cause implanted positrons to drift towards a surface of the moderator material. Additionally, the method may comprise establishing a magnetic field throughout the volume of said moderator structure in the direction orthogonal to said electric field. The method may further comprise extracting low energy positrons by E×B charged particle drift out through said vacuum gaps.

In some embodiments, the cathode and anodes may be made of material suited for transmission of positrons (e.g., aluminum, etc.) and the moderator may be made of wide band gap semiconductor material (e.g., silicon carbide, gallium arsenide, gallium nitride, diamond, etc.) suitable for high velocity drift in the presence of an electric field.

In some embodiments, a method using the apparatus may be provided. The method may comprise producing positrons via a pair-production process by collisions of high energy photons, electrons or neutrons with atoms in said source material, located adjacent to the moderator structure and made of material suited for pair production (e.g., platinum, tungsten, etc.).

In some embodiments, the method may further comprise establishing an electric field between the cathodes and anodes to cause implanted positrons to drift towards a surface of the moderator material. Additionally, the method may comprise establishing a magnetic field throughout the volume of said moderator structure in the direction orthogonal to said electric field. The method may further comprise extracting low energy positrons by E×B charged particle drift out through said vacuum gaps.

BRIEF DESCRIPTION OF THE DRAWINGS

Figure 1:
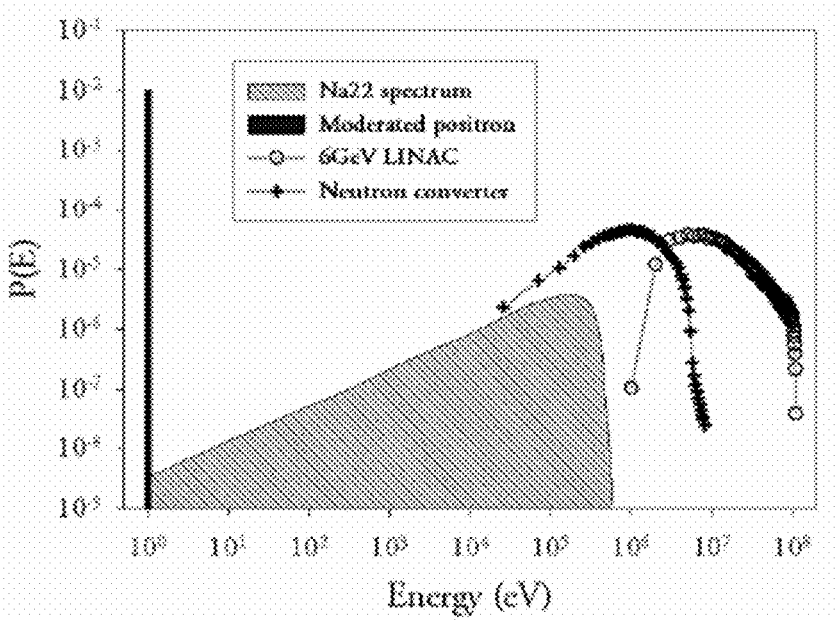
Figure 2:
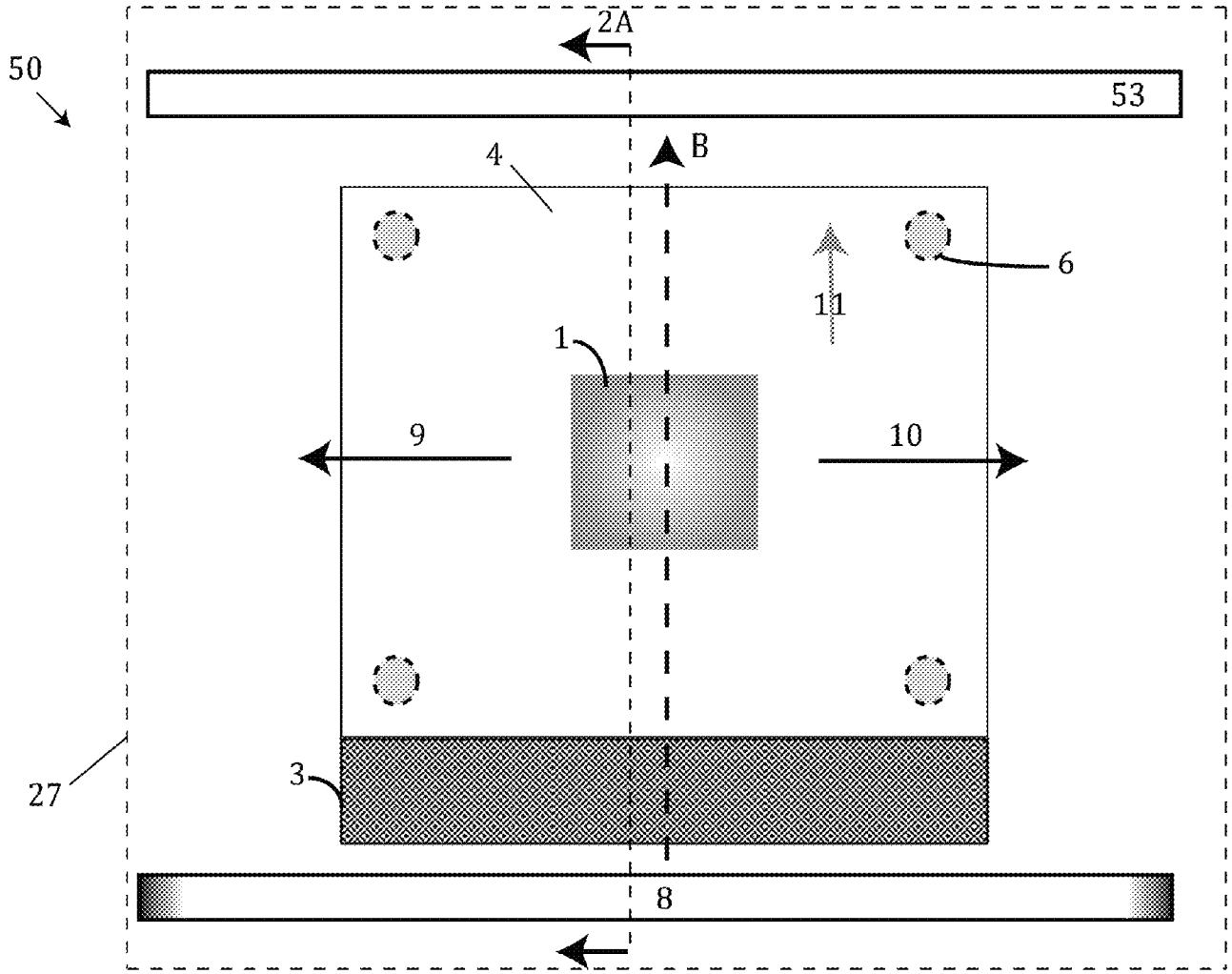
Figure 2A:
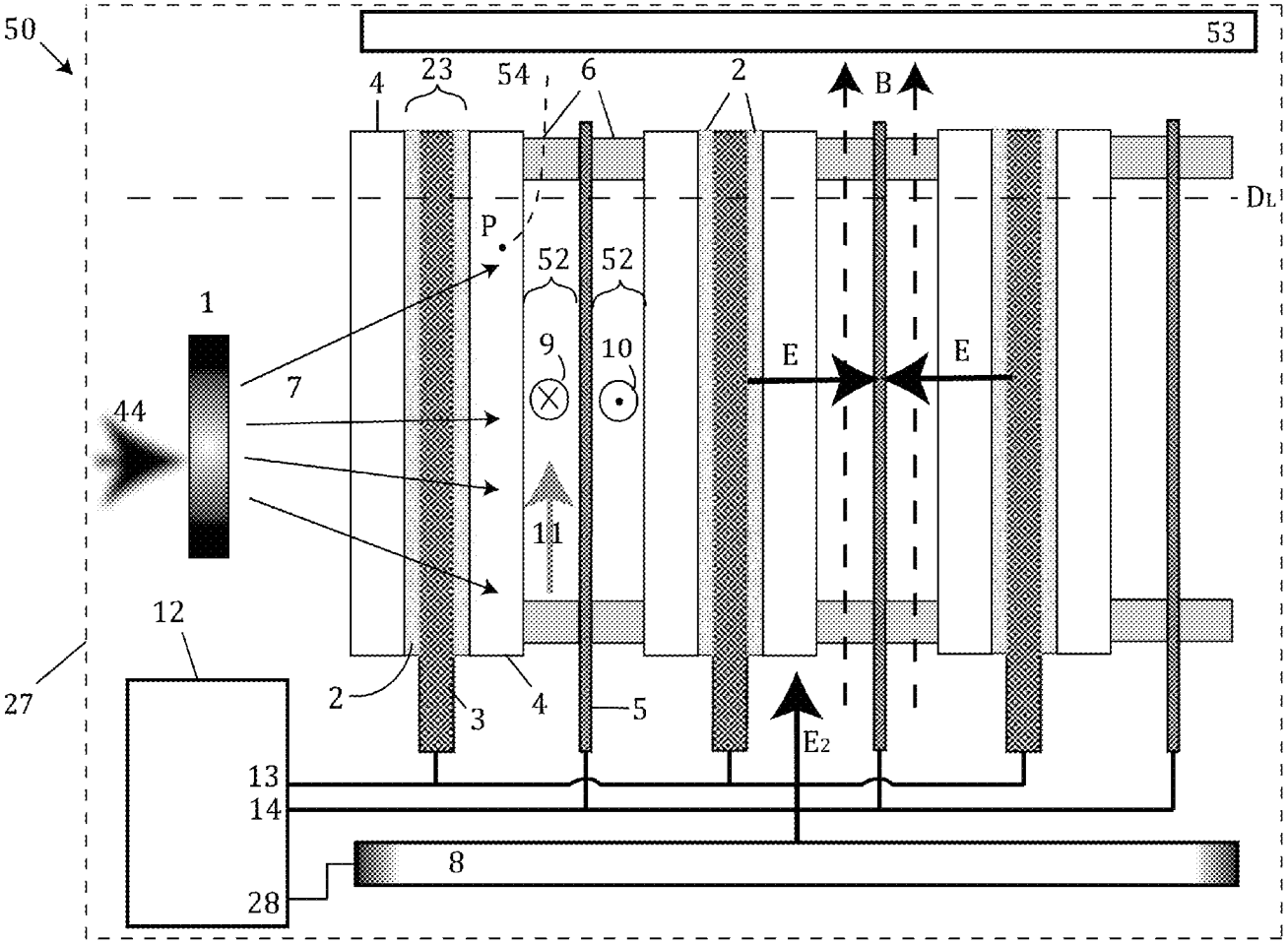
Figure 3:
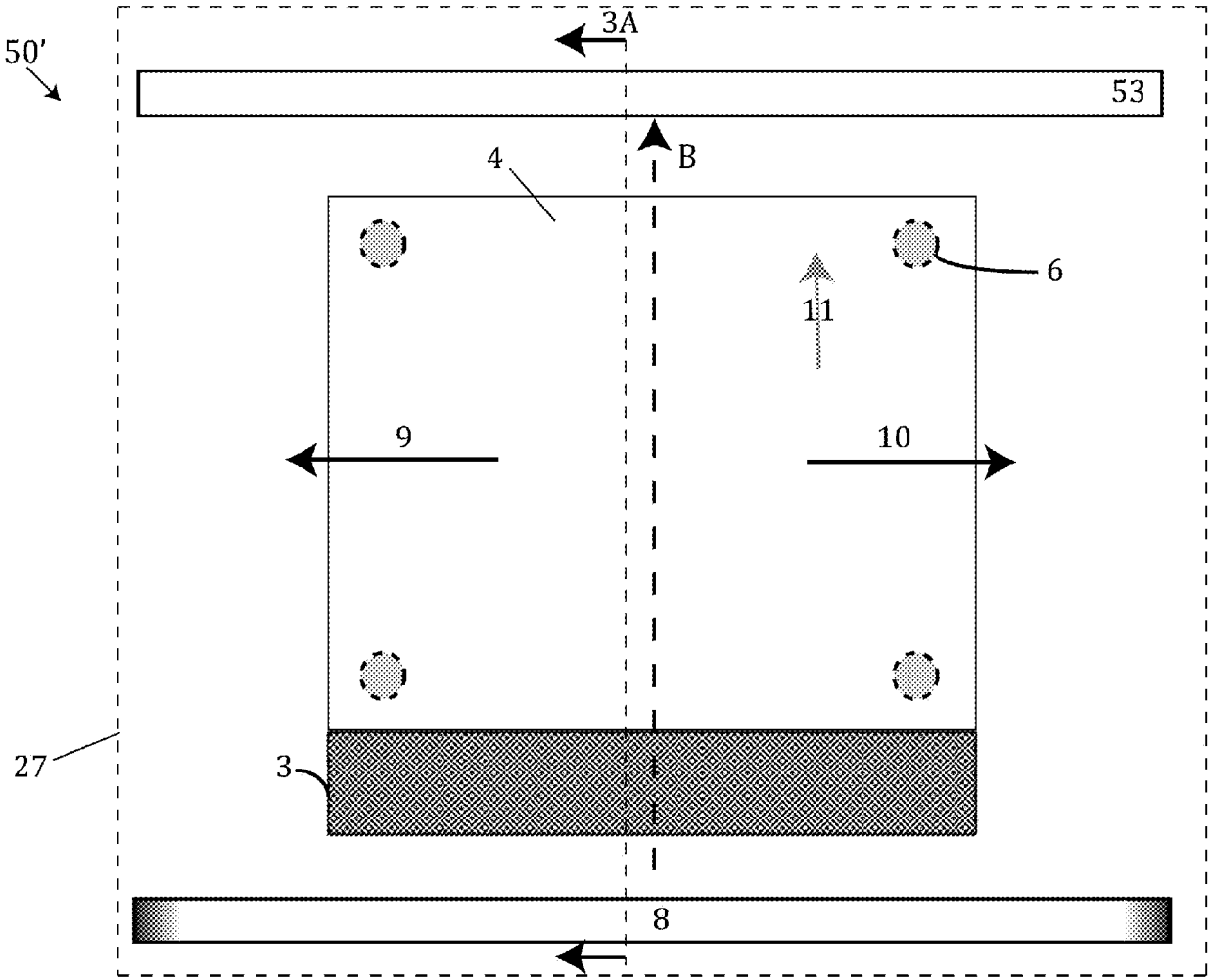
Figure 3A:
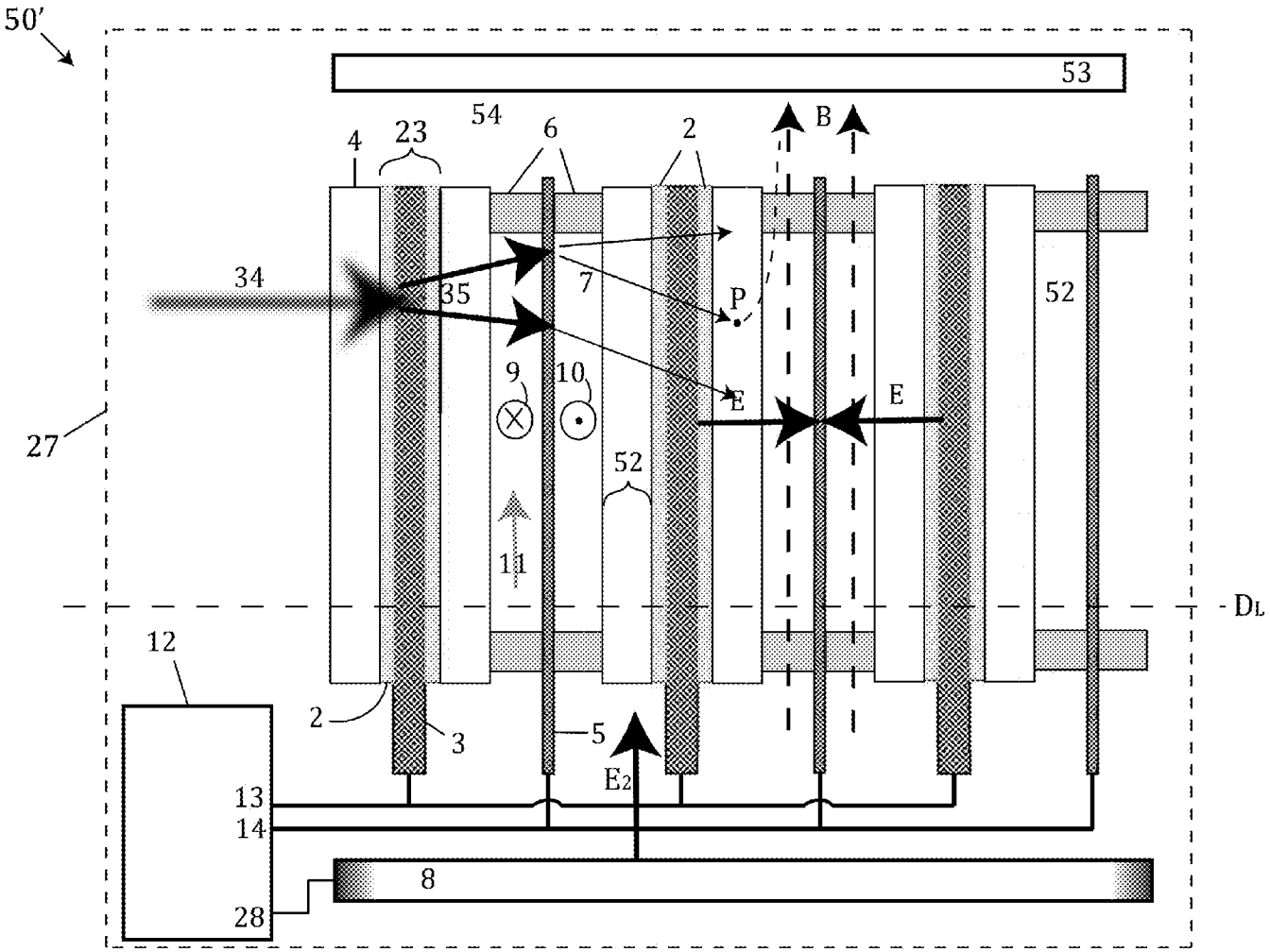
Figure 4:
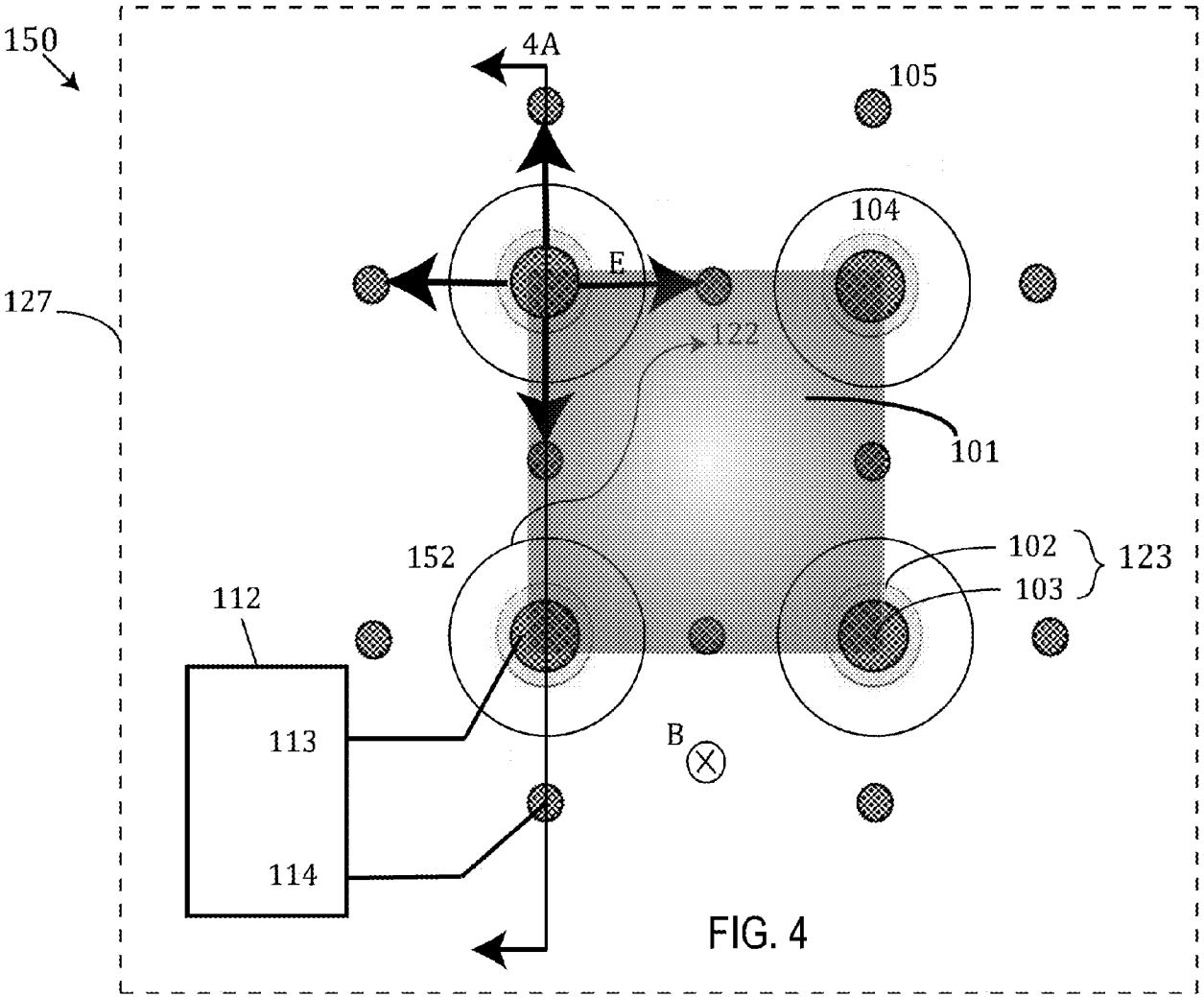
Figure 4A:
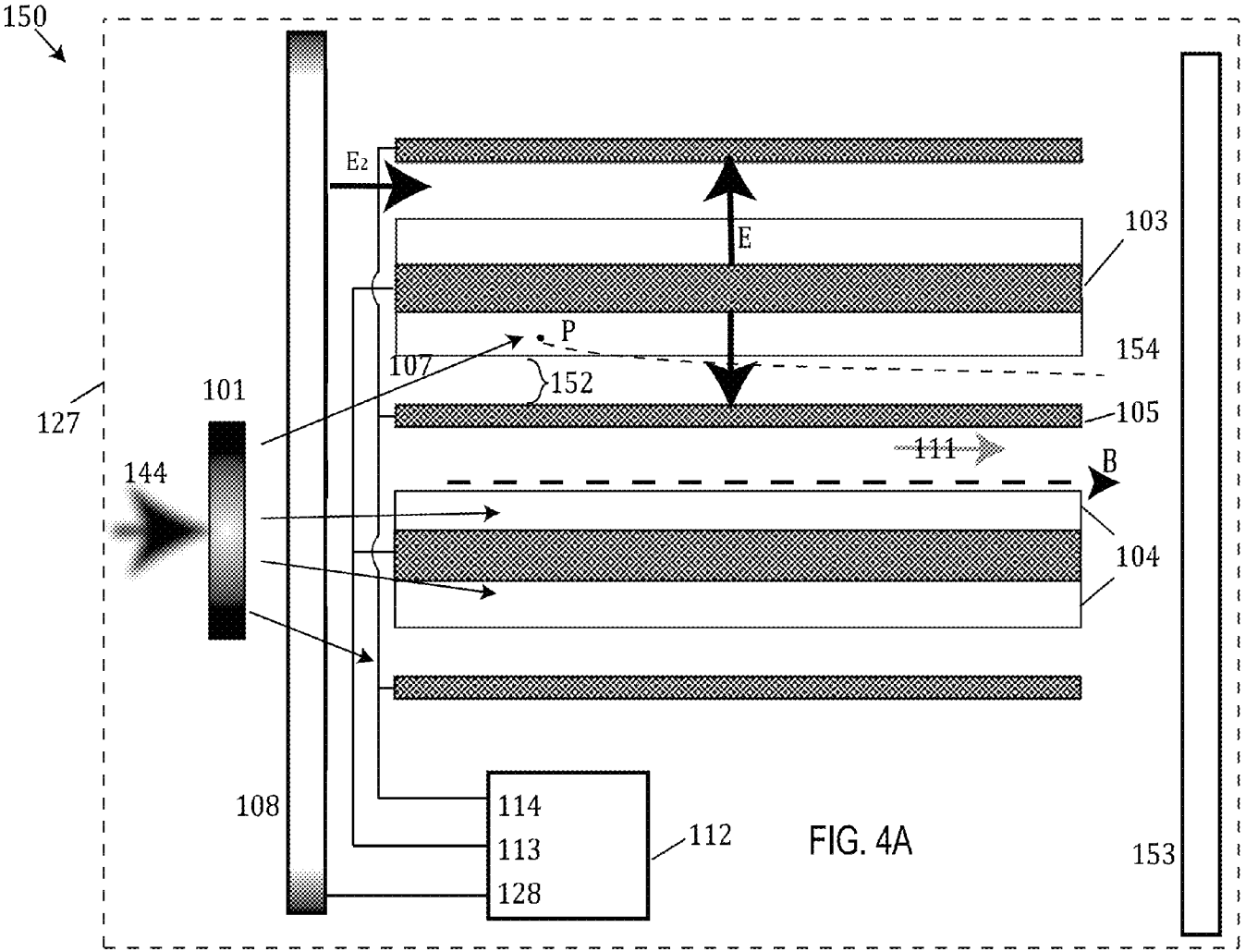
Figure 5:
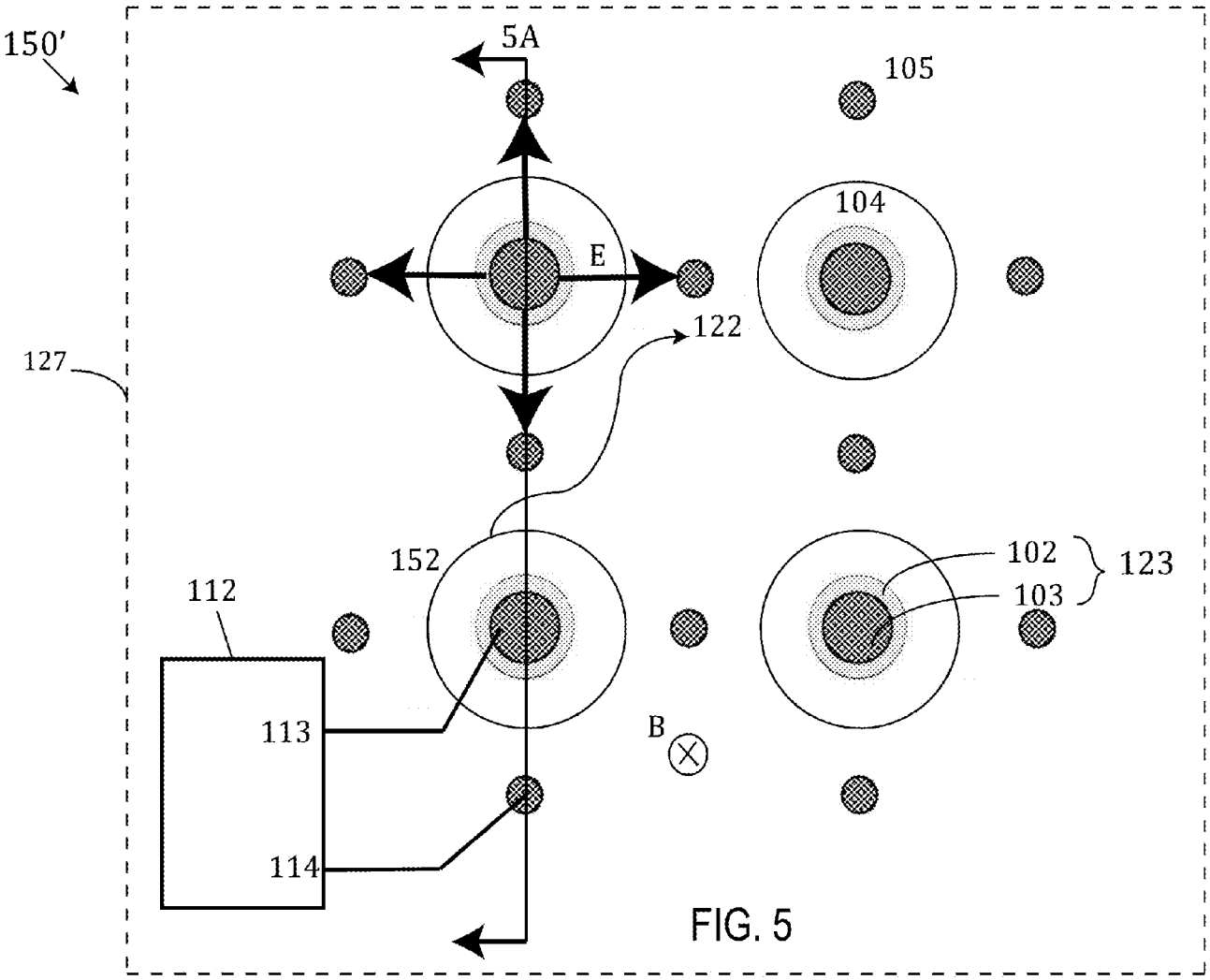
Figure 5A:
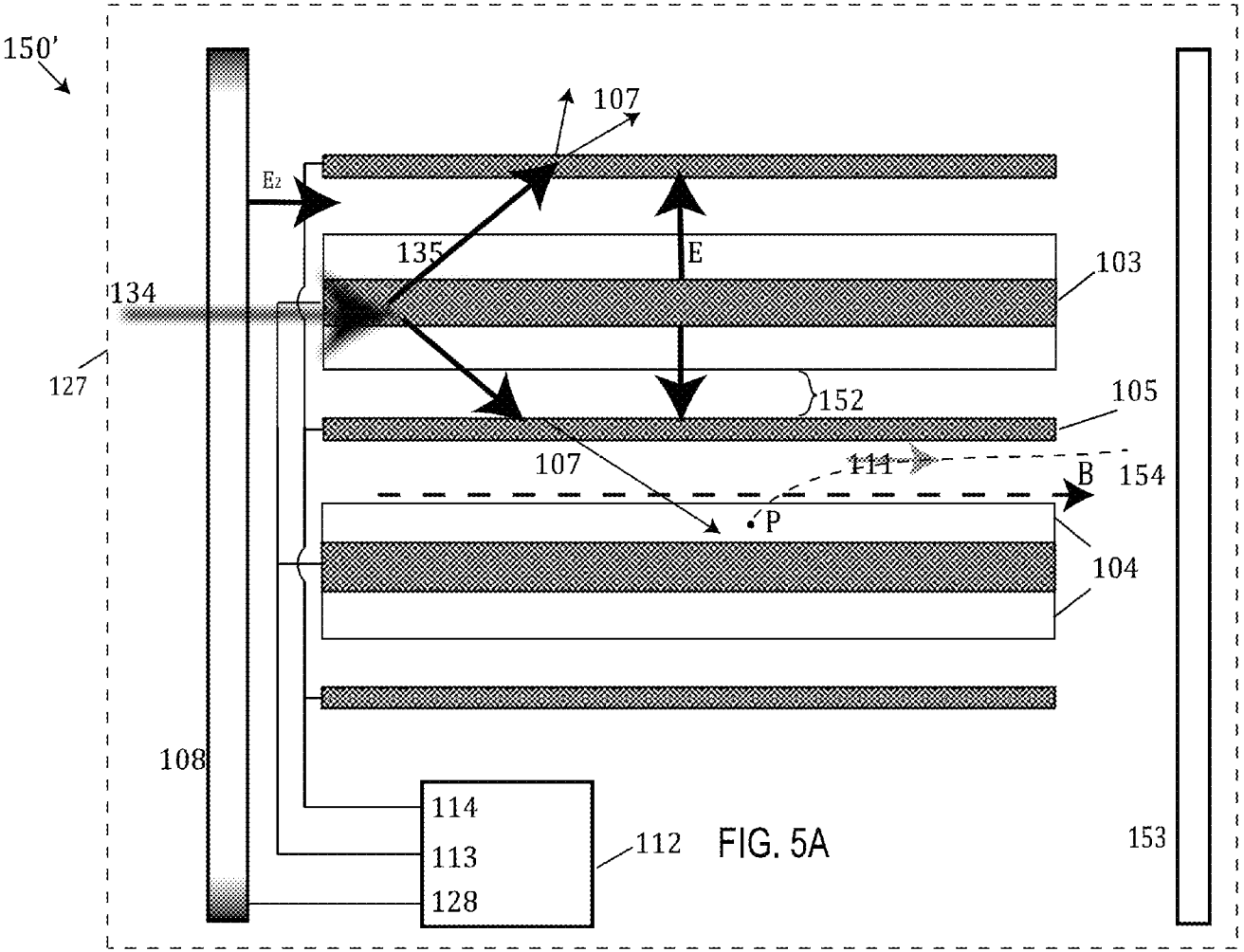
Figure 6:
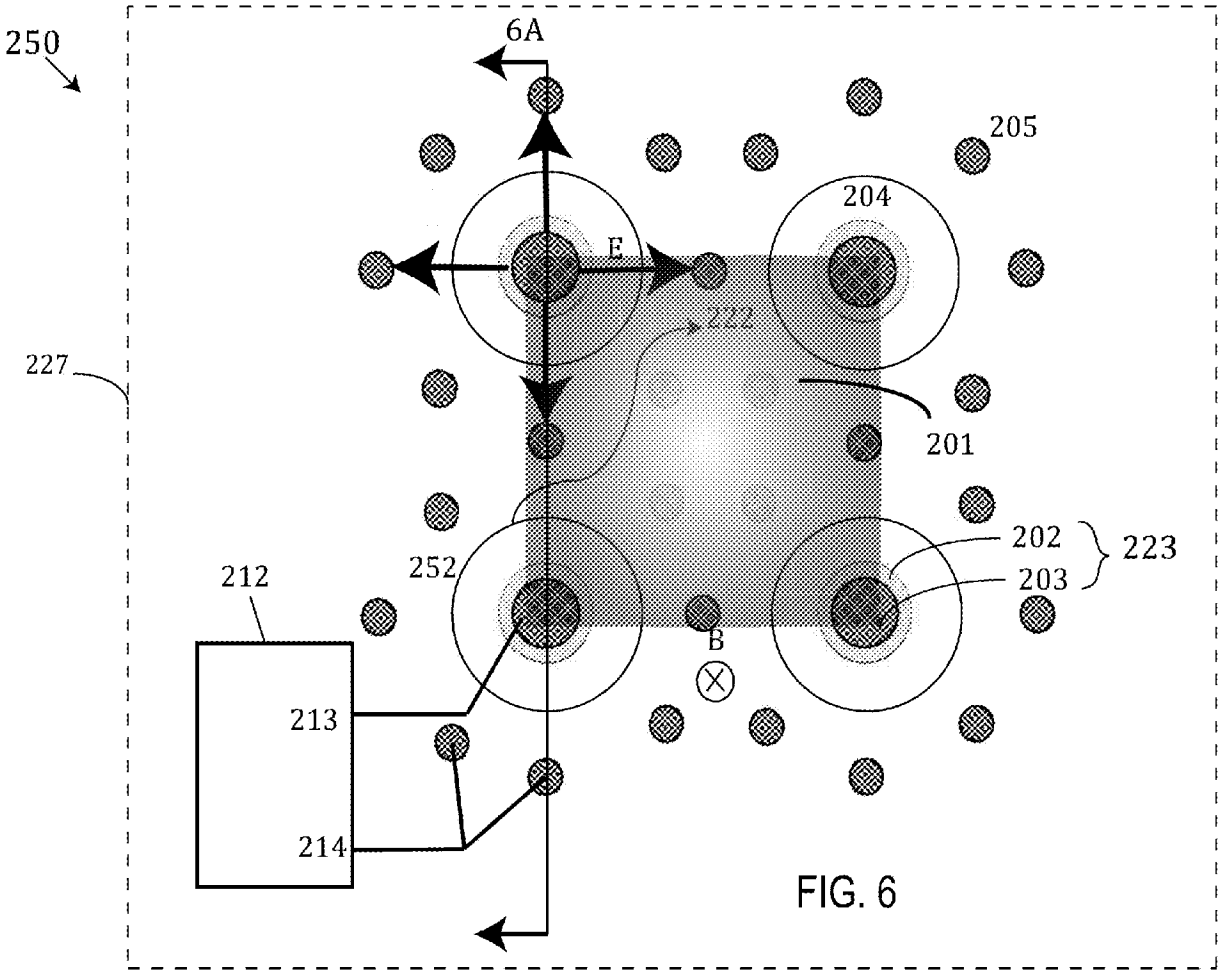
Figure 6A:
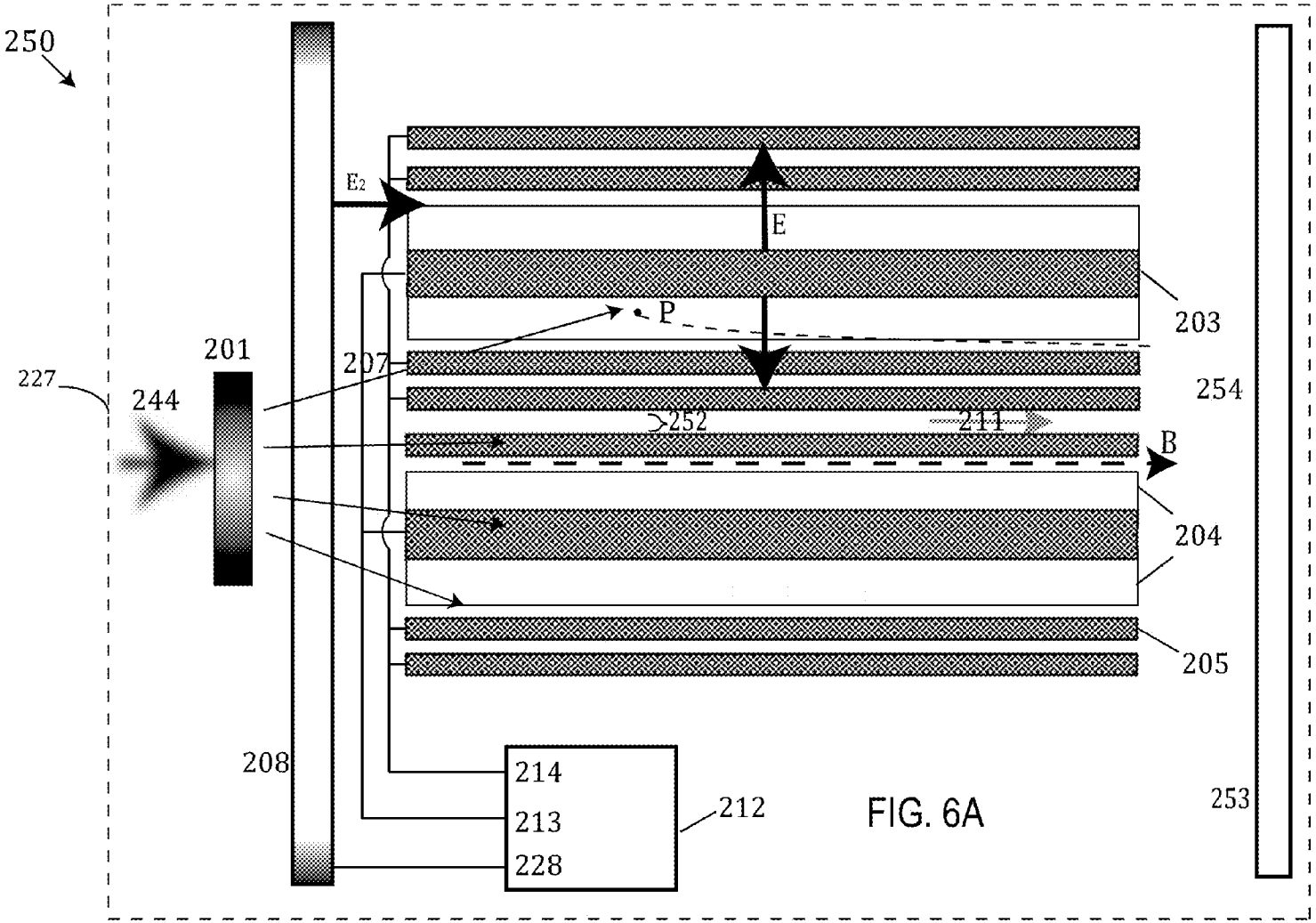
Figure 7:
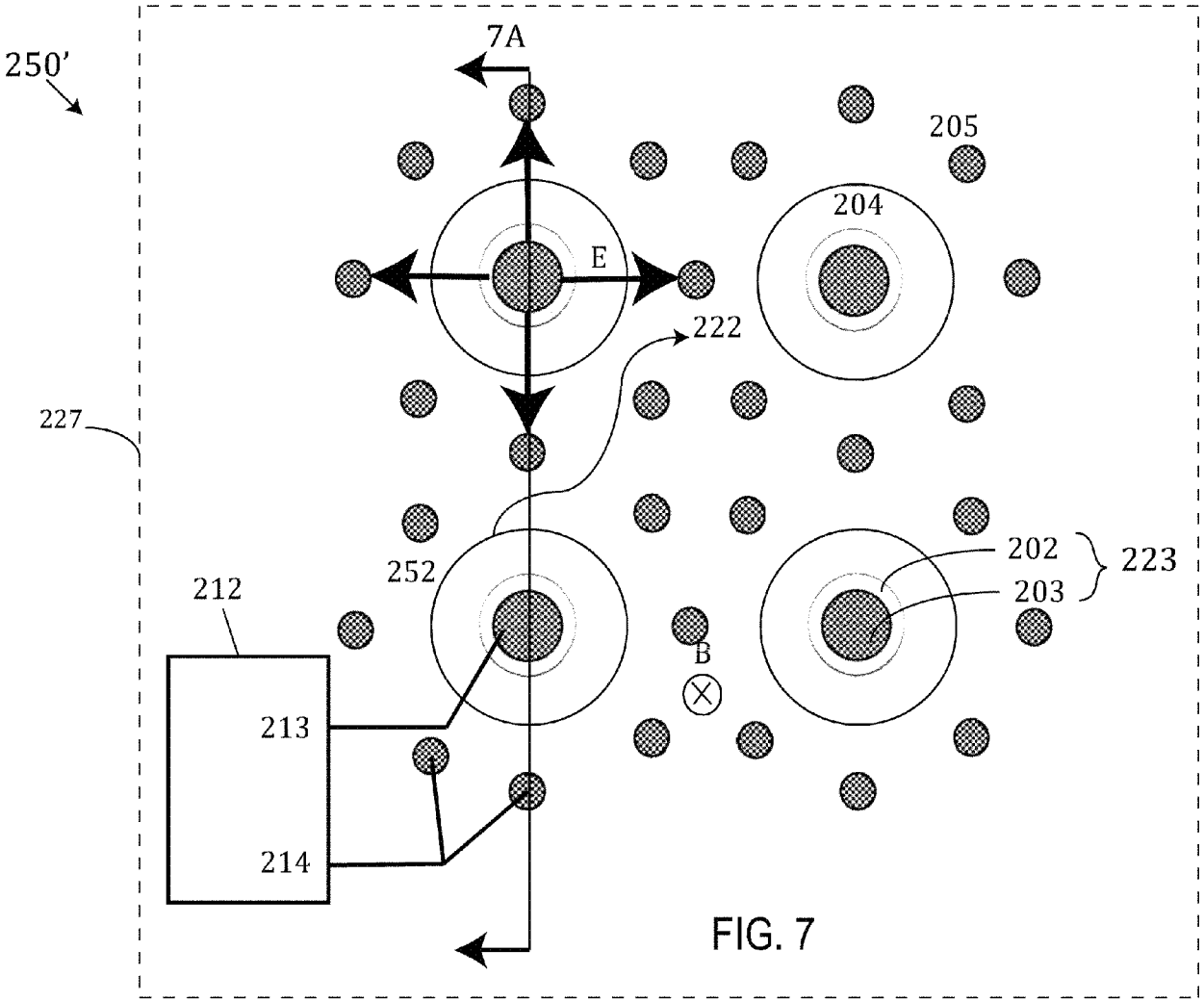
Figure 7A:
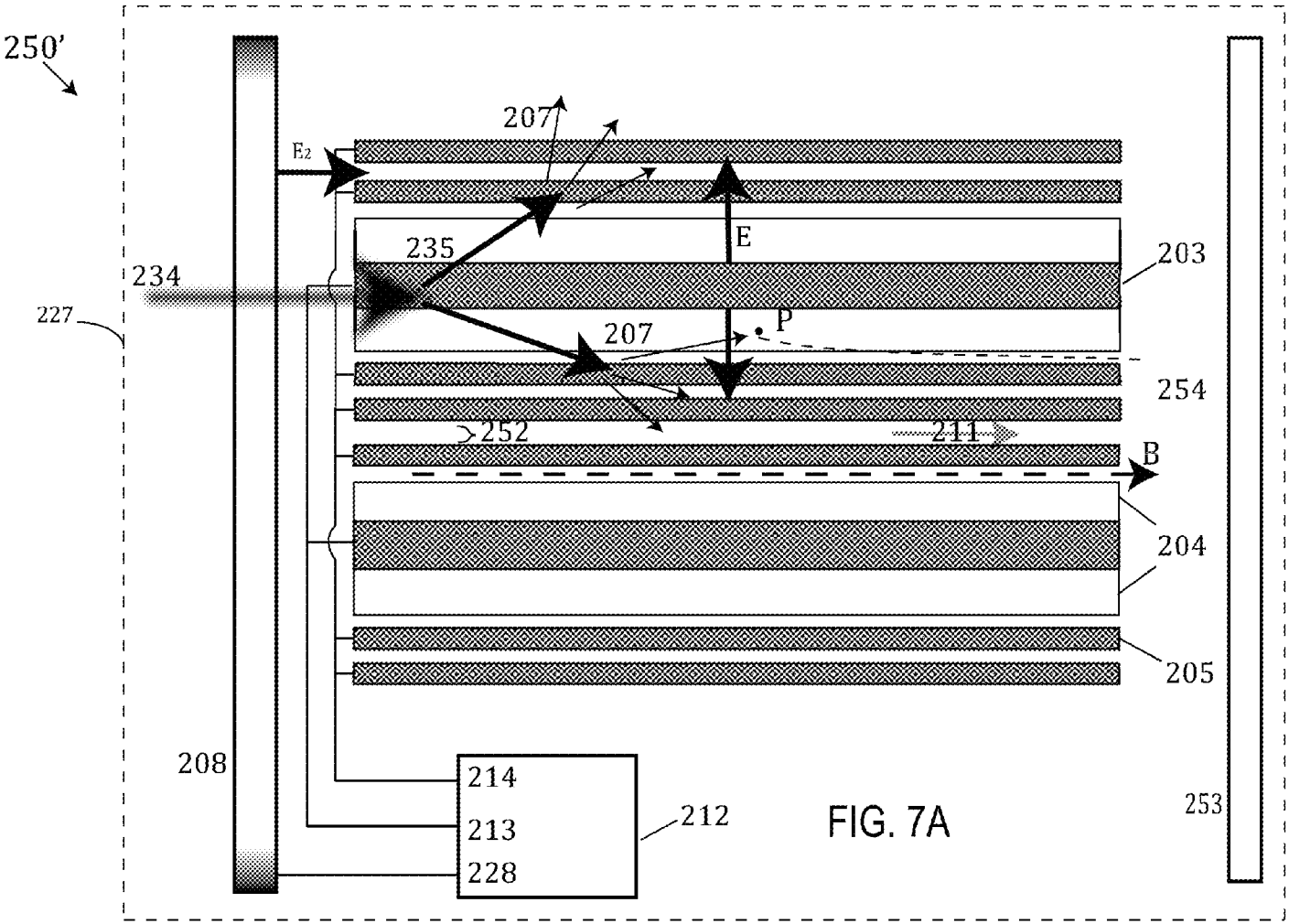
Figure 8:
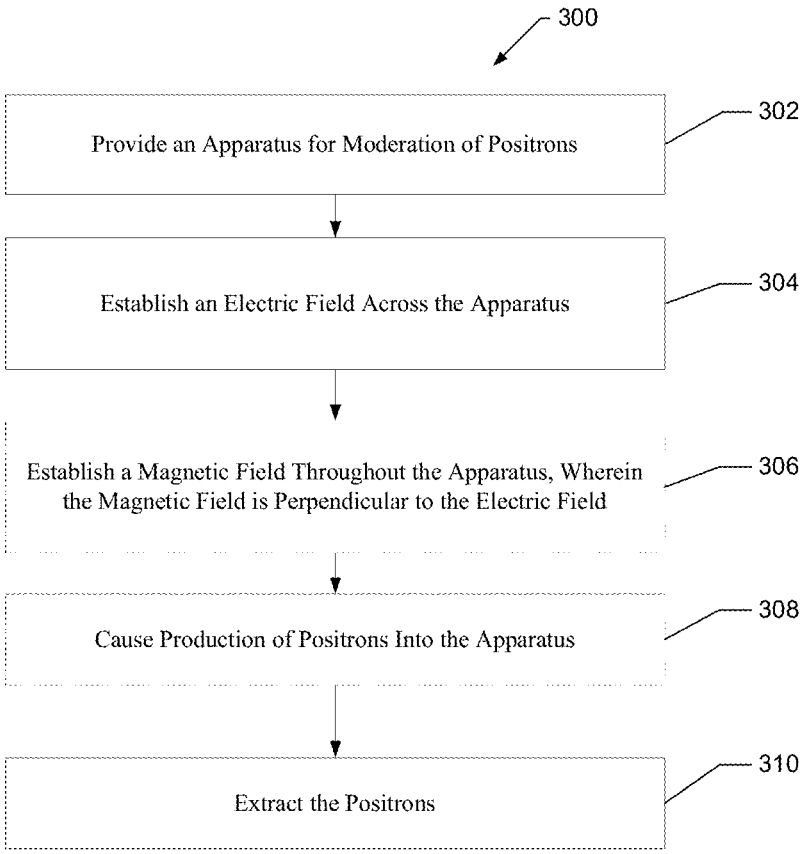
Figure 9:
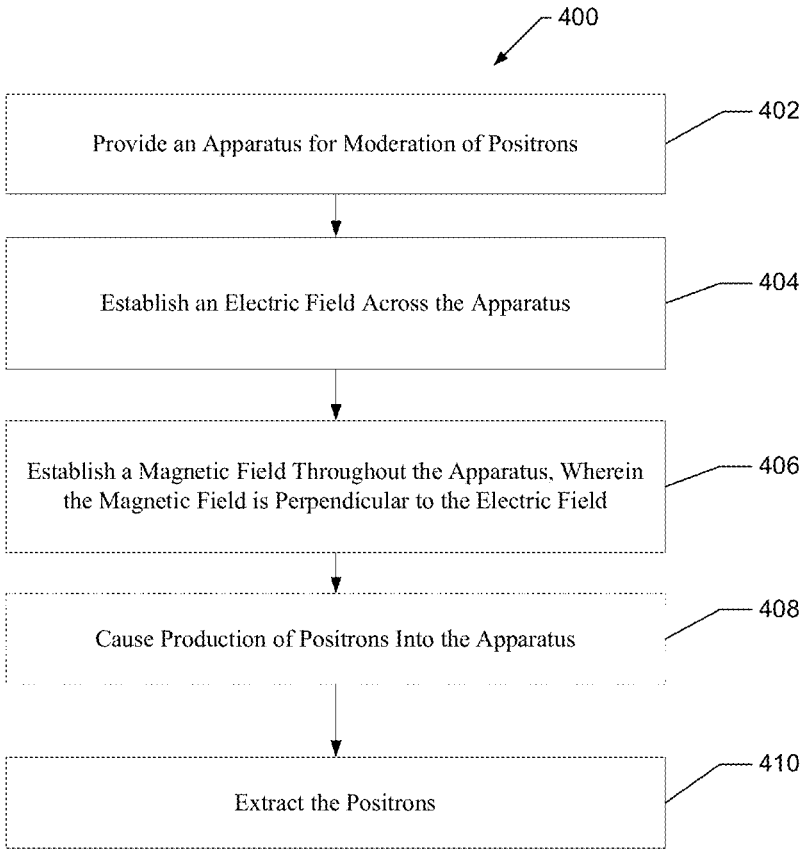

Having thus described the invention in general terms, reference will now be made to the accompanying drawings, which are not necessarily drawn to scale, and wherein:

FIG. 1 illustrates energy distribution for various positron sources, including a Na-22 radioisotope, a neutron converter source using the $_{113}$Cd (n, γ)$_{114}$Cd reaction, and a 6 GeV electron LINAC source, wherein the moderated positrons result from a solid neon moderator;

FIG. 2 is a schematic representation showing a front view of an apparatus for moderation of positrons, wherein cathode structures and anodes are arranged in a plane to form a planar array, and wherein positrons are produced from collision of electrons with a converter, in accordance with an example embodiment of the present invention;

FIG. 2A is a schematic representation showing a cross-section view of the apparatus shown in FIG. 2 taken along line 2A of FIG. 2, in accordance with an example embodiment of the present invention;

FIG. 3 is a schematic representation showing a front view an apparatus for moderation of positrons, wherein cathode structures and anodes are arranged in a plane to form a planar array, and wherein neutrons are emitted into the apparatus to produce positrons, in accordance with another example embodiment of the present invention;

FIG. 3A is a schematic representation showing a cross-section view of the apparatus shown in FIG. 3 taken along line 3A of FIG. 3, in accordance with an example embodiment of the present invention;

FIG. 4 is a schematic representation showing a front view of an apparatus for moderation of positrons, wherein each cathode structure is radially surrounded by four anodes to form a quadrupole array, and wherein positrons are produced from collision of electrons with a converter, in accordance with another example embodiment of the present invention;

FIG. 4A is a schematic representation showing a cross-section view of the apparatus shown in FIG. 4 taken along line 4A of FIG. 4, in accordance with an example embodiment of the present invention;

FIG. 5 is a schematic representation showing a front view of an apparatus for moderation of positrons, wherein each cathode structure is radially surrounded by four anodes to form a quadrupole array, and wherein neutrons are emitted into the apparatus to produce positrons, in accordance with another example embodiment of the present invention;

FIG. 5A is a schematic representation showing a cross-section view of the apparatus shown in FIG. 5 taken along line 5A of FIG. 5, in accordance with an example embodiment of the present invention;

FIG. 6 is a schematic representation showing a front view of an apparatus for moderation of positrons, wherein each cathode structure is radially surrounded by eight anodes to form a octopole array, and wherein positrons are produced from collision of electrons with a converter, in accordance with another example embodiment of the present invention;

FIG. 6A is a schematic representation showing a cross-section view of the apparatus shown in FIG. 6 taken along line 6A of FIG. 6, in accordance with an example embodiment of the present invention;

FIG. 7 is a schematic representation showing a front view of an example apparatus for moderation of positrons, wherein each cathode structure is radially surrounded by eight anodes to form a octopole array, and wherein neutrons are emitted into the apparatus to produce positrons, in accordance with another example embodiment of the present invention;

FIG. 7A is a schematic representation showing a cross-section view of the apparatus shown in FIG. 7 taken along line 7A of FIG. 7, in accordance with an example embodiment of the present invention;

FIG. 8 illustrates a flowchart according to an example method for moderation of positrons, in accordance with an example embodiment of the present invention; and FIG. 9 illustrates a flowchart according to another example method for moderation of positrons, in accordance with an example embodiment of the present invention.

DETAILED DESCRIPTION OF THE PREFERRED EMBODIMENTS

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Positrons generated in the laboratory may be produced via two methods; nuclear beta decay and pair production. Each method produces positrons with a large energy distribution which is dependent on the source type. See FIG. 1. In order to be useful, each positron must be stored. However, storage of positrons requires their kinetic energy to be low enough that their movement may be affected by electric and magnetic fields. Therefore, positron sources must produce positrons with a near-thermal kinetic energy distribution (less than a few electronvolts) in order to be useful for positron collection. Indeed, cooling the 'hot' positrons from the source, or moderation, has been done using a variety of methods, but none with efficiencies>$7\times10^{-3}$.

Radioactive sources of positrons produce the lowest average energy positrons of any production method, although they are limited in their maximum intensity. Typical radioactive sources emit positrons with an energy distribution extending up to 1 MeV, while LINAC based positron sources have much higher positron energy distributions with average energies up to a few tens of a MeV. LINAC facilities obtain electron energies up to 6 GeV (Jefferson Lab) with currents of 200 μA giving a positron energy distribution shown in FIG. 1. These high electron energies cause the positrons to emit with corresponding high energies that limit the ability of moderators to capture and cool positrons. For example, for a typical radioactive source such as Na-22, around 90% of the positrons pass through the moderator un-cooled, 9% of the positrons annihilate in the bulk of the moderator, and up to 1% of the positrons are thermalized and are emitted from the surface due to the negative work function of the moderator material (up to several eV). On the other hand, for a LINAC source with much higher positron production rate and an average positron energy>5 MeV, the fraction of moderated positrons drops to $10^{-6}$.

The challenge with solid positron moderators is to minimize losses due to annihilations in the bulk of the solid moderator, while still having a thick enough structure to thermalize a significant portion of the positrons. Thus, an optimal thickness is arrived at for most traditional thin film moderators in the range of a few microns.

The efficiency of modern positron moderators is currently limited by the short diffusion length of positrons inside the bulk, typically a few or tens of nanometers. In the presence of an electric field, however, positrons will gain a drift velocity in the direction of the field, increasing their diffusion length. This technique is referred to as field assisted moderation (FAM). FAM has been used to increase positron diffusion length in a diamond thin film by applying a potential to a deposited gold mesh. While this method has previously demonstrated the enhanced mobility of positrons in an electric field, efficiency was decreased due to enhanced annihilation at the deposited gold mesh lines. FAM has also been demonstrated in frozen rare-gases and in wide band-gap semiconductor materials by surface charging via electron bombardment, although the method is limited by the absolute magnitude of electric field that can be applied.

FIG. 2 illustrates a schematic representation showing a front view of an example apparatus for moderation of positrons. FIG. 2A illustrates a schematic representation of a cross-section of the apparatus taken along line 2A in FIG. 2. In the depicted embodiment of FIGS. 2 and 2A, the apparatus 50 may comprise elements that are generally planar shaped (e.g., rectangular). As used herein, such an example apparatus may be used for positron moderation that may be termed Planar Array Field Assisted Moderation (PAFAM).

The apparatus 50 and its components may be positioned inside a vacuum chamber 27 evacuated to a suitably low pressure. The apparatus 50 may comprise at least one cathode structure 23 positioned within the vacuum chamber 27. In some embodiments the cathode structure 23 may comprise a cathode 3 configured to receive a positive potential from a voltage source 12. In the depicted embodiment, three rectangular cathode structures 23 are positioned in parallel along a longitudinal direction ($D_L$) to form a planar array. While the depicted embodiment illustrates three cathode structures, embodiments of the present invention are not meant to be limited to three cathode structures, as indeed any number of cathode structures may be used.

The apparatus 50 may also comprise a moderator material 4 attached to at least a portion of the at least one cathode structure 23. The moderator material 4 is configured to receive (e.g., at least partially slow down and/or trap) positrons that contact the moderator material 4. In the depicted embodiment, the moderator material 4 coats both sides of the cathode structure 23 (e.g., the moderator material 4 lies adjacent to each side of the cathode structure 23). The moderator material 4 may comprise any of a wide range of wide-band-gap-semiconductor (WBGS) materials (e.g., Silicon Carbide, Gallium Arsenide, Gallium Nitride, Diamond, etc.) or other suitable FAM capable materials In some embodiments the cathode structure 23 may comprise both a cathode 3 and an insulating material 2. In such an embodiment, the insulating material 2 may be attached to at least a portion of the cathode 3 and may be positioned between the moderator material 4 and the cathode 3. The insulating material 2 may be configured to increase the electrical resistance between the cathode 3 and the moderator material 4, which may increase the time it takes for the surfaces of the moderator material 4 to become charged.

The apparatus 50 may comprise at least one anode 5 positioned within the vacuum chamber. In some embodiments the anode 5 may comprise an anode configured to receive a negative potential from a voltage source 12. In the depicted embodiment, three anodes 5 are positioned along a longitudinal direction ($D_L$) to form a planar array with the cathode structures 23. While the depicted embodiment illustrates three anodes, embodiments of the present invention are not meant to be limited to three anodes, as indeed any number of anodes may be used.

In some embodiments, the at least one anode 5 may be spaced apart from the at least one cathode structure 23 and the moderator material 4 so as to define a vacuum gap 52 between the moderator material 4 and the at least one anode 5. In the depicted embodiment, spacers 6 are used to position the anodes 5 apart from the cathode structures 23. The vacuum gap 52 provides additional area for the positron to drift so as to avoid collision with an electron, thereby resulting in annihilation, which may occur when the positron collides with the anode 5.

The apparatus 50 may comprise a voltage source 12 connected to the at least one cathode structure 23 and the at least one anode 5. The voltage source 12 may be configured to apply a positive potential 13 to the at least one cathode structure 23 and a negative potential 14 to the at least one anode 5 to create an electric field (E). In some embodiments, the positive potential 13 and negative potential 14 may be applied in a DC or pulsed-mode to match the time-domain behavior of the positron source (such as will be described in greater detail herein). The electric field (E) may be configured to cause the positrons received by (e.g., implanted in, partially or otherwise) the moderator material 4 to drift away from the moderator material 4, such as toward the surface of the moderator material 4. Additionally, in embodiments with a vacuum gap 52, the electric field (E) may be configured to cause the positrons to drift away from the moderator material 4 toward the vacuum gap 52.

In some embodiments, the apparatus 50 may comprise a magnetic field source 53, such a magnetic coil assembly, configured to produce a magnetic field (B) in at least a portion of the at least one cathode structure 23 and the at least one anode 5. The magnetic field (B) may be perpendicular to the electric field (E) and configured to cooperate with the electric field (E) to encourage the positrons to drift toward a harvesting area 54. In the depicted embodiment, the magnetic field (B) is configured to cooperate with the electric field (E) to encourage the positrons to drift through the vacuum gap 52 toward the harvesting area 54. In the depicted embodiment, the harvesting area 54 is an area outside of the plane of the at least one cathode structure 23 and at least one anode 5, where the positrons may be extracted and harvested for later use.

In addition, in embodiments with a magnetic field (B) and an electric field (E), positrons released from the moderator material 4 may undergo an E×B drift, so as to move in either direction 9 (e.g., into the page of FIG. 2A) or 10 (e.g., out from the page of FIG. 2A). In some embodiments, the cathode 3 and anode 5 extend slightly out from the moderator material 4 to enhance E×B drift of the positrons in directions 9 and 10 (e.g., toward the harvesting area 54).

Embodiments of the present invention seek to provide apparatuses and methods for the moderation of positrons. As noted above, there may be different ways to produce positrons. Indeed, the example apparatuses and methods presented herein may be suited for use with different methods of production of positrons. For example, FIGS. 2 and 2A illustrate use of an electron source and an electron converter to produce positrons for the apparatus 50. In another example embodiment, FIGS. 3 and 3A illustrate a similar apparatus 50' in which positrons are produced from neutrons. The embodiment illustrated in FIGS. 3 and 3A will be described in greater detail herein. In this regard, it should be noted that many different positron production techniques are possible and should be considered as within the scope of the present invention. For example, a gamma-ray source (e.g., an Undulator) may be used with some embodiments of the present invention. In such an embodiment, the cathode or anode material may act to produce positrons from interaction with the gamma-rays.

With reference to FIGS. 2 and 2A, in some embodiments, the apparatus 50 may comprise an electron source and a positron source. In the depicted embodiment, the positron source may comprise a converter 1 positioned within the vacuum chamber proximate the at least one cathode structure 23. The electron source (e.g., a LINAC, a cyclotron, etc.) may be configured to emit electrons 44 toward the converter 1. The converter 1 may be configured to produce positrons (e.g., represented by arrows 7) upon collision of the electrons 44 with the converter 1. In some embodiments, the converter 1 may comprise a wide range of materials including high-Z (e.g., Tungsten) converter materials suited for production of positrons from incident high energy electrons.

Referring to FIG. 2A, in some cases, a positron (P) may be emitted from the converter 1 (e.g., represented by arrows 7) and received by a first moderator material 4. Depending on the energy of the positron (P), the positron (P) may travel through the first moderator material 4 and through the first cathode structure 23, all the while reducing its energy (e.g., cooling). Eventually, when the energy is low enough, the positron (P) may be received by (e.g., implanted in) a moderator material (e.g., shown in FIG. 2A). The electric field (E) may cause the positron (P) to drift toward the surface of the moderator material 4 (e.g., away from the cathode 3 and toward the anode 5). Additionally, the magnetic field (B) may cause the positron (P) to drift with the magnetic field (e.g., along arrow 11). In such a way, the positron (P) may drift away from the moderator material 4, into the vacuum gap 52, and into the harvesting area 54 for extraction. In such a manner, the apparatus 50 may be used to moderate and extract a positron.

In some embodiments, the converter 1 is smaller than the at least one cathode structure 23 and the at least one anode 5. In particular, the converter 1 may produce positrons that travel in many different directions. Thus, in some embodiments, the cathode structure 23 with moderator material 4 may be larger than the converter 1 in order to allow more of the positrons to be received by the moderator material 4.

In some embodiments, the apparatus 50 may comprise an additional electric field source 8. In some embodiments, a positive electric potential 28 may be applied to a hollow cylindrical end-cap electrode 8 by the voltage source 12 to create a second electric field ($E_2$) that causes positrons that drift outside of the at least one cathode structure 23 and at least one anode 5 in a direction opposite to the magnetic field (B) to reflect back towards the at least one cathode structure 23 and at least one anode 5. Thus, the second electric field ($E_2$) encourages positrons to redirect into the magnetic field (B) and toward the harvesting area to enable their extraction.

FIG. 3 illustrates a schematic representation showing a front view of another example apparatus for moderation of positrons. FIG. 3A illustrates a schematic representation of a cross-section of the apparatus taken along line 3A in FIG. 3. With reference to FIGS. 3 and 3A, in another example embodiment, apparatus 50' may be configured to receive positrons produced from neutrons. In other respects, the apparatus 50' may be configured in a similar manner to apparatus 50 and with other embodiments described herein.

In some embodiments, the apparatus 50' may comprise a neutron source and a positron source. The neutron source (not shown) may be configured to emit neutrons 34 toward the at least one cathode structure 23. The cathode structure 23 may be configured to emit gamma-rays 35 upon capture of the neutrons 34 by the cathode 3 of the at least one cathode structure 23. The anode 5, in turn, may be configured to produce positrons 7 upon collision of the gamma-rays 35 with the at least one anode 5 such that the at least one anode 5 acts as the positron source. As a result, similar to other example embodiments, a positron (P) may be received by the moderator material 4. The electric field (E) may cause the positron (P) to drift toward the surface of the moderator material 4 (e.g., away from the cathode 3 and toward the anode 5). Additionally, the magnetic field (B) may cause the positron (P) to drift with the magnetic field (e.g., along arrow 11). In such a way, the positron (P) may drift away from the moderator material 4, into the vacuum gap 52, and into the harvesting area 54 for extraction. In such a manner, the apparatus 50' may be used to moderate and extract positrons.

As noted above, any example embodiment of the present invention (e.g., apparatus 50, 50') may include more than one cathode structure and anode positioned along a longitudinal direction ($D_L$). Indeed, in some cases, dependent on the amount of energy a positron has, the positron may pass through a vacuum gap 52 and penetrate through the nearest anode 5 into the next vacuum gap 52 and into the next set of moderator material 4 and cathode structure 23. In such a manner, the positron may become slowed down and/or received by the next moderator material 4. This process may continue based on the energy of the positron and the number of cathode structures 23 and anodes 5. Thus, in some embodiments, to ensure maximum efficiency, the total number of cathode structures 23 and anodes 5 may be selected to correspond to the projected energy of the positrons 7, such that the total depth of the apparatus may be larger than the maximum positron implantation depth associated with the particular positron source (e.g., electron source and converter or neutron source). For example, in the case of a neutron source (not shown), to ensure maximum efficiency, the total number of cathode structures 23 and anodes 5 may depend on the energy of the positrons 7 such that the total depth of moderator material may be larger than the maximum positron implantation depth plus the maximum implantation depth of neutrons 34 that bombard the apparatus 50' (e.g., ranging, as an example, from 1 mm to several cm).

Embodiments of the present invention conceive of many types of apparatuses for moderation of positrons, including apparatuses that comprise cathode structures and anodes that are in many different arrangements. For example, FIGS. 4, 4A, 5, and 5A illustrate other example apparatuses 150, 150' for moderation of positrons that includes anodes that are arranged in a quadrupole form around a cathode structure. Positron moderation that uses such example embodiments may be referred to herein as Quadrupole Array Field Assisted Moderation (QAFAM). Similarly, FIGS. 6, 6A, 7, and 7A illustrate other example apparatuses 250, 250' for moderation of positrons that include anodes that are arranged in an octopole form around a cathode structure. Positron moderation that uses such example embodiments may be referred to herein as Octopole Array Field Assisted Moderation (OAFAM). Any of the example embodiments (e.g., apparatuses 150, 150', 250, 250') may employ any of the features described above with respect to apparatuses 50, 50'.

FIG. 4 illustrates a schematic representation showing a front view of another example apparatus for moderation of positrons. FIG. 4A illustrates a schematic representation of a cross-section of the apparatus taken along line 4A in FIG. 4. In particular, FIGS. 4 and 4A show an apparatus 150 configured for moderation of positrons. Similar to other example embodiments, the apparatus 150 may be positioned within a vacuum chamber 127 and may comprise at least one cathode structure 123 and at least one anode 105. However, with reference to FIG. 4, the cathode 103 and anode 105 may each define a cylindrical shape. Additionally, each cathode structure 123 may be radially surrounded by four anodes 105.

As described above with respect to other example apparatuses for moderation of positrons, the apparatus 150 may comprise a moderator material 104 configured to receive positrons. Additionally, a voltage source 112 may apply a positive potential 113 to each cathode 103 and a negative potential 114 to each anode 105 in order to create an electric field (E) that causes the positrons to drift toward the surfaces of the moderator material 104 and into the vacuum gap 152. Moreover, a magnetic field (B) may be applied perpendicular to the electric field (E) and may be configured to cooperate with the electric field (E) to cause the positrons to drift out of the vacuum gap 152 and toward the harvesting area 154 for extraction. Such a process is illustrated with the projected path of positron (P) (represented by a dashed line).

In addition, depending on where the positrons are emitted from the moderator material 104, they may undergo E×B drift. In some cases, the E×B drift trajectory may include simple rotation around the cathode structure 123, or, in other cases, a diffusion like trajectory (e.g., shown by arrow 122 in FIG. 4) away from the cathode structure 123.

Additionally, such a configuration may be useful with any type of positron production. For example, FIGS. 4 and 4A illustrate use of an electron source and an electron converter to produce positrons for the apparatus 150. In another example embodiment, FIGS. 5 and 5A illustrate a similar apparatus 150' that receives positrons produced from neutrons.

With reference to FIGS. 4 and 4A, the apparatus 150 may comprise an electron source (not shown). Additionally, the positron source may include a converter 101 positioned within the vacuum chamber proximate the at least one cathode structure 123. The electron source (not shown) may be configured to emit electrons 144 toward the converter 101 such that upon collision with the converter 101 the electrons 144 produce positrons (e.g., represented by arrows 107).

FIG. 5 illustrates a schematic representation showing a front view of another example apparatus for moderation of positrons. FIG. 5A illustrates a schematic representation of a cross-section of the apparatus taken along line 5A in FIG. 5. With reference to FIGS. 5 and 5A, apparatus 150' may comprise a neutron source and a positron source. The neutron source (not shown) may be configured to emit neutrons 134 toward the at least one cathode structure 123. The cathode structure 123 may be configured to emit gamma-rays 135 upon capture of the neutrons 134 by the at least one cathode structure 123. Additionally, the anode 105 may be configured to produce positrons 107 upon collision of the gamma-rays 135 with the at least one anode 105 such that the at least one anode 105 acts as the positron source.

Additionally, in some embodiments, the apparatuses 150, 150' may comprise an additional electric field source 108 to create a second electric field ($E_2$). The second electric field may be configured to cause positrons that drift outside of the at least one cathode structure 123 and at least one anode 105 in a direction opposite to the magnetic field (B) to reflect back towards the at least one cathode structure 123 and at least one anode 105.

In some embodiments, the apparatus 150, 150' may comprise multiple cathode structures 123, each with four corresponding anodes 105 positioned within the vacuum chamber 127. Indeed, as shown in the depicted embodiments of FIGS. 4 and 5, adjacent cathode structures 123 may share certain anodes 105. In some cases, dependent on the amount of energy a positron has, the positron may pass through a vacuum gap 152 and penetrate through the nearest anode 105 into the next vacuum gap 152 and into the next set of moderator material 104 and cathode structure 123. In such a manner, the positron may become slowed down and/or received by the next moderator material 104. This process may continue based on the amount of energy of the positron and the number of sets of a cathode structure 123 and anodes 105. Thus, in some embodiments, to ensure maximum efficiency, the total number of sets of cathode structure 123 and anodes 105 may be selected to correspond to the projected energy of the positrons 107, such that the total depth/width of the apparatus 150, 150' may be larger than the maximum positron implantation depth associated with the particular positron source (e.g., electron source and converter or neutron source). Along these lines, only four sets of a cathode structure 123 and anodes 105 are shown with respect to apparatuses 150, 150'; however, any number of sets of a cathode structure 123 and anodes 105 are contemplated by embodiments of the present invention.

FIG. 6 illustrates a schematic representation showing a front view of another example apparatus for moderation of positrons. FIG. 6A illustrates a schematic representation of a cross-section of the apparatus taken along line 6A in FIG. 6. In particular, FIGS. 6 and 6A show an apparatus 250 configured for moderation of positrons. Similar to other example embodiments, the apparatus 250 may be positioned within a vacuum chamber 227 and may comprise at least one cathode structure and at least one anode. However, with reference to FIG. 6, the cathode 203 and anode 205 may each define cylindrical shapes. Additionally, each cathode structure 223 may be radially surrounded by eight anodes 205.

As described above with respect to other example apparatuses for moderation of positrons, the apparatus 250 may comprise a moderator material 204 configured to receive positrons. Additionally, a voltage source 212 may apply a positive potential 213 to each cathode 203 and a negative potential 214 to each anode 205 in order to create an electric field (E) that causes the positrons to drift away from the moderator material 204 and into the vacuum gap 252. Moreover, a magnetic field (B) may be applied perpendicular to the electric field (E) and configured to cooperate with the electric field (E) to cause the positrons to drift out of the vacuum gap 252 and into the harvesting area 254 for extraction. Such a process is illustrated with the projected path of positron (P).

In addition, depending on where the positrons are emitted from the moderator material 204, they may undergo E×B drift. In some cases, the E×B drift trajectory may include simple rotation around the cathode structure 223, or, in other cases, a diffusion like trajectory (e.g., shown by arrow 222) away from the cathode structure 223.

Additionally, such a configuration may be useful with any type of positron production. For example, FIGS. 6 and 6A illustrate use of an electron source and an electron converter to produce positrons for the apparatus 250. In another example embodiment, FIGS. 7 and 7A illustrate a similar apparatus 250' that receives positrons produced from neutrons.

With reference to FIGS. 6 and 6A, the apparatus 250 may comprise an electron source (not shown). Additionally, the positron source may include a converter 201 positioned within the vacuum chamber proximate the at least one cathode structure 223. The electron source (not shown) may be configured to emit electrons 244 toward the converter 201 such that upon collision with the converter 201 the electrons 244 produce positrons (e.g., represented by arrows 207).

FIG. 7 illustrates a schematic representation showing a front view of another example apparatus for moderation of positrons. FIG. 7A illustrates a schematic representation of a cross-section of the apparatus taken along line 7A in FIG. 7. With reference to FIGS. 7 and 7A, apparatus 250' may comprise a neutron source and a positron source. The neutron source (not shown) may be configured to emit neutrons 234 toward the at least one cathode structure 223. The cathode structure 223 may be configured to emit gamma-rays 235 upon collision of the neutrons 234 with the at least one cathode structure 223. Additionally, the anode 205 may be configured to produce positrons 207 upon collision of the gamma-rays 235 with the at least one anode 205 such that the at least one anode 205 acts as the positron source.

Additionally, in some embodiments, the apparatuses 250, 250' may comprise an additional electric field source 208 to create a second electric field ($E_2$). The second electric field may be configured to cause positrons that drift outside of the at least one cathode structure 223 and at least one anode 205 in a direction opposite to the magnetic field (B) to reflect back towards the at least one cathode structure 223 and at least one anode 205.

In some embodiments, the apparatus 250, 250' may comprise multiple sets of one cathode structure 223 and four anodes 205 positioned within the vacuum chamber. Indeed, as shown in the depicted embodiments of FIGS. 6 and 7, adjacent cathode structures 223 may share certain anodes 205. In some cases, dependent on the amount of energy a positron has, the positron may pass through a vacuum gap 252 and penetrate through the nearest anode 205 into the next vacuum gap 252 and set of moderator material 204 and cathode structure 223. In such a manner, the positron may become slowed down and/or received by the next moderator material 204. This process may continue based on the amount of energy of the positron and the number of sets of a cathode structure 223 and anodes 205. Thus, in some embodiments, to ensure maximum efficiency, the total number of sets of cathode structure 223 and anodes 205 may be selected to correspond to the projected energy of the positrons 207, such that the total depth/width of the apparatus 250, 250' may be larger than the maximum positron implantation depth associated with the particular positron source (e.g., electron source and converter, or neutron source). Along these lines, only four sets of a cathode structure 223 and anodes 205 are shown with respect to apparatuses 250, 250', however, any number of sets of a cathode structure 223 and anodes 205 are contemplated by embodiments of the present invention.

While the above described embodiments with respect to FIGS. 4, 4A, 5, 5A, 6, 6A, 7, and 7A comprise either 4 or 8 anodes surrounding a cathode structure, a greater or fewer number of anodes may be used. Consequently, the present invention should not be regarded as limited to any particular number of anodes with respect to each cathode. Along these same lines, other geometries of cathodes and anodes are also contemplated by embodiments of the present invention.

In some embodiments, such as any of the embodiments of the present invention described herein, in order to maximize the number of positrons emitted from the surface of the moderator material 4, 104, 204, wide band gap semiconductor (WBGS) materials that can support high saturation positron drift velocities and long bulk positron lifetimes may be used (see Table 1). In addition, in some embodiments, the distance the positrons must drift is minimized by making the moderator material 4, 104, 204 as thin as possible (e.g., <50 μm). In some embodiments, the fraction of positrons that thermalize in the moderator material 4 are maximized by minimizing the thickness and density of the insulating material 2, 102, 202 and the cathode 3, 103, 203 compared to the moderator material 4, 104, 204.

TABLE 1

Material and electrical properties of interest for field assisted moderation for various wide band gap semiconductor (WBGS) materials. $E_g$ is the bandgap energy, ρ the density, $V^{sat}$ is the electron saturation drift velocity, ϕ is the electron work function, and $\tau_{bulk}$ is the bulk positron lifetime.

| Material | $E_g$ ((e)V) | ρ (g/cm$^3$) | $V^{sat}$ ($10^5$ m/s) | ϕ (eV) | $\tau_{bulk}$ (ps) |
|---|---|---|---|---|---|
| Diamond | 5.5 | 3.52 | 1.5 | −3.03 | 105 |
| 2H—GaN | 3.4 | 6.15 | 2.5 | −2.4 | 166 |
| 6H—SiC | 3.05 | 3.21 | 2 | −3 | 140 |
| GaAs | 1.42 | 5.31 | 2 | −0.6 | 231 |

In embodiments of the present invention described herein, the cathode 3, 103, 203 and anode 5, 105, 205 materials may be conductive. In such a manner, a range of metals or metal alloys (e.g., Aluminum, Gold, Tungsten, Platinum) may be used. Additionally, in some embodiments, it may be possible to use the moderator material 4, 104, 204 as the cathode 3, 103, 203 by finding suitable p-type implants to form electrode layers. The thicknesses of the material of the cathode 3, 103, 203 and anode 5, 105, 205 may be small (e.g., <10 μm). In some embodiments, the insulating material 2, 102, 202 may be a composed of a thin (e.g., <5 μm) range of high resistivity materials (e.g., Teflon®, Kapton®). Similarly, in some embodiments, the insulating spacer 6 may be composed of a range of high-resistivity materials (e.g., Teflon, Kapton).

FIG. 8 illustrates a flowchart according to an example method for moderation of positrons according to an example embodiment 300. Operation 302 may comprise providing an apparatus for moderation of positrons, such as any apparatus described herein. In particular, the apparatus may comprise at least one cathode structure and at least one anode spaced from the cathode structure so as to define a vacuum gap. Operation 304 may comprise establishing an electric field across the apparatus by applying a positive potential to the at least one cathode structure of the apparatus and applying a negative potential to the at least one anode apparatus.

In some embodiments, operation 306 may comprise establishing a magnetic field throughout the at least one cathode structure and the at least one anode, wherein the magnetic field is perpendicular to the electric field.

In some embodiments, operation 308 may comprise causing production of positrons within the apparatus. For example, in some embodiments, positrons may be produced by causing emission of electrons toward a converter, wherein the converter is configured to produce positrons upon collision of the electrons with the converter. In other embodiments, positrons may be produced by causing emission of neutrons toward the at least one cathode structure, wherein the at least one cathode structure is configured to emit gamma-rays upon capture of the neutrons by the at least one cathode structure. Additionally, the at least one anode is configured to produce positrons upon collision of the gamma-rays with the at least one anode such that the anode acts as a positron source.

Finally, operation 310 may comprise extracting the positrons that drift away from the moderator material, such as through the vacuum gap and into the harvesting area.

FIG. 9 illustrates a flowchart according to an example method for moderation of positrons according to an example embodiment 400. Operation 402 may comprise providing an apparatus for moderation of positrons, such as any apparatus described herein. Operation 404 may comprise establishing an electric field across the apparatus by applying a positive potential to the at least one cathode structure of the apparatus and applying a negative potential to the at least one anode apparatus. Operation 406 may comprise establishing a magnetic field throughout the at least one cathode structure and the at least one anode, wherein the magnetic field is perpendicular to the electric field.

In some embodiments, operation 408 may comprise causing production of positrons within the apparatus. For example, in some embodiments, positrons may be produced by causing emission of electrons toward a converter, wherein the converter is configured to produce positrons upon collision of the electrons with the converter. In other embodiments, positrons may be produced by causing emission of neutrons toward the at least one cathode structure, wherein the at least one cathode structure is configured to emit gamma-rays upon capture of the neutrons by the at least one cathode structure. Additionally, the at least one anode is configured to produce positrons upon collision of the gamma-rays with the at least one anode such that the anode acts as a positron source.

Finally, operation 410 may comprise extracting the positrons that drift away from the moderator material, such as through the vacuum gap and into the harvesting area.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. An apparatus for moderation of positrons, the apparatus comprising:

a vacuum chamber;

at least one cathode structure positioned within the vacuum chamber;

a moderator material attached to at least a portion of the at least one cathode structure, wherein the moderator material is configured to receive positrons from a positron source;

at least one anode positioned within the vacuum chamber and spaced apart from the at least one cathode structure and moderator material so as to define a vacuum gap between the moderator material and the at least one anode; and a voltage source connected to the at least one cathode structure and the at least one anode, wherein the voltage source is configured to apply a positive potential to the at least one cathode structure and a negative potential to the at least one anode to create an electric field that is configured to cause the positrons received by the moderator material to drift toward a surface of the moderator material and into a vacuum gap.

2. The apparatus according to claim 1 further comprising a magnetic field source configured to produce a magnetic field across throughout the at least one cathode structure and the at least one anode, wherein the magnetic field is perpendicular to the electric field and is configured to cooperate with the electric field to encourage the positrons to drift through the vacuum gap toward a harvesting area.

3. The apparatus according to claim 1 further comprising an electron source, wherein the positron source comprises a converter positioned within the vacuum chamber proximate the at least one cathode structure, wherein the electron source is configured to emit electrons toward the converter, wherein the converter is configured to produce positrons upon collision of the electrons with the converter.

4. The apparatus according to claim 1 further comprising a neutron source configured to emit neutrons toward the at least one cathode structure, wherein the at least one cathode structure is configured to emit gamma-rays upon capture of the neutrons by the at least one cathode structure, and wherein the at least one anode is configured to produce positrons upon collision of the gamma-rays with the at least one anode such that the at least one anode acts as the positron source.

5. The apparatus according to claim 1, wherein the at least one cathode structure comprises at least two cathode structures, wherein the at least one anode comprises at least two anodes, and wherein the at least two cathode structures and the at least two anodes are positioned along a plane so as to form a planar array.

6. The apparatus according to claim 1, wherein the at least one cathode structure defines a cylindrical shape, wherein the at least one anode comprises four anodes spaced radially from the at least one cathode structure, wherein each of the anodes defines a cylindrical shape.

7. The apparatus according to claim 1, wherein the at least one cathode structure defines a cylindrical shape, wherein the at least one anode comprises eight anodes spaced radially from the at least one cathode structure, wherein each of the anodes defines a cylindrical shape.

8. The apparatus according to claim 1, wherein the at least one cathode structure comprises a cathode and an insulator material positioned between the moderator material and the cathode, wherein the insulator material is configured to increase electrical resistance between the cathode and the moderator material.

9. An apparatus for moderation of positrons, the apparatus comprising:

a vacuum chamber;

at least one cathode structure positioned within the vacuum chamber;

a moderator material attached to at least a portion of the at least one cathode structure, wherein the moderator material is configured to receive positrons from a positron source;

at least one anode positioned within the vacuum chamber;

a voltage source connected to the at least one cathode structure and the at least one anode, wherein the voltage source is configured to apply a positive potential to the at least one cathode structure and a negative potential to the at least one anode to create an electric field that is configured to cause the positrons received by the moderator material to drift toward a surface of the moderator material; and a magnetic field source configured to produce a magnetic field throughout the at least one cathode structure and the at least one anode, wherein the magnetic field is perpendicular to the electric field and configured to cooperate with the electric field to encourage the positrons to drift toward a harvesting area.

10. The apparatus according to claim 9, wherein the at least one anode is spaced apart from the at least one cathode structure so as to define a vacuum gap between the moderator material and the at least one anode, wherein the magnetic field is configured to cooperate with the electric field to cause the positrons to drift through the vacuum gap toward the harvesting area.

11. The apparatus according to claim 9 further comprising an electron source, wherein the positron sources comprises a converter positioned within the vacuum chamber proximate the at least one cathode structure, wherein the electron source is configured to emit electrons toward the converter, wherein the converter is configured to produce positrons upon collision of the electrons with the converter.

12. The apparatus according to claim 9 further comprising a neutron source configured to emit neutrons toward the at least one cathode structure, wherein the at least one cathode structure is configured to emit gamma-rays upon capture of the neutrons by the at least one cathode structure, and wherein the at least one anode is configured to produce positrons upon collision of the gamma-rays with the at least one anode such that the at least one anode acts as a positron source.

13. The apparatus according to claim 9, wherein the at least one cathode structure comprises at least two cathode structures, wherein the at least one anode comprises at least two anodes, and wherein the at least two cathode structures and the at least two anodes are positioned along a plane so as to form a planar array.

14. The apparatus according to claim 9, wherein the at least one cathode structure defines a cylindrical shape, wherein the at least one anode comprises four anodes spaced radially from the at least one cathode structure, wherein each of the anodes defines a cylindrical shape.

15. The apparatus according to claim 9, wherein the at least one cathode structure defines a cylindrical shape, wherein the at least one anode comprises eight anodes spaced radially from the at least one cathode structure, wherein each of the anodes defines a cylindrical shape.

16. The apparatus according to claim 9, wherein the at least one cathode structure comprises a cathode and an insulator material positioned between the moderator material and the cathode, wherein the insulator material is configured to increase electrical resistance between the cathode and the moderator material.

17. A method for moderation of positrons, the method comprising:

providing an apparatus comprising:

a vacuum chamber;

at least one cathode structure positioned within the vacuum chamber;

a moderator material attached to at least a portion of the at least one cathode structure, wherein the moderator material is configured to receive positrons from a positron source;

at least one anode positioned within the vacuum chamber and spaced apart from the at least one cathode structure and moderator material so as to define a vacuum gap between the moderator material and the at least one anode; and a voltage source connected to the at least one cathode structure and the at least one anode;

establishing an electric field across the apparatus by applying a positive potential to the at least one cathode structure and applying a negative potential to the at least one anode, wherein the electric field is configured to cause the positrons received by the moderator material to drift toward a surface of the moderator material and into the vacuum gap; and extracting the positrons that drift away from the moderator material through the vacuum gap.

18. The method of claim 17 further comprising establishing a magnetic field throughout the at least one cathode structure and the at least one anode, wherein the magnetic field is perpendicular to the electric field and configured to cooperate with the electric field to encourage the positrons to drift through the vacuum gap toward a harvesting area.

19. The method according to claim 17 further comprising causing emission of electrons toward the positron source, wherein the positron source comprises a converter positioned within the vacuum chamber proximate the at least one cathode structure, wherein the converter is configured to produce positrons upon collision of the electrons with the converter.

20. The method according to claim 17 further comprising causing emission of neutrons toward the at least one cathode structure, wherein the at least one cathode structure is configured to emit gamma-rays upon capture of the neutrons by the at least one cathode structure, and wherein the at least one anode is configured to produce positrons upon collision of the gamma-rays with the at least one anode such that the anode acts as the positron source.

21. A method for moderation of positrons, the method comprising:

providing an apparatus comprising:

a vacuum chamber;

at least one cathode structure positioned within the vacuum chamber;

a moderator material attached to at least a portion of the at least one cathode structure, wherein the moderator material is configured to receive positrons from a positron source;

at least one anode positioned within the vacuum chamber; and a voltage source connected to the at least one cathode structure and the at least one anode;

establishing an electric field across the apparatus by applying a positive potential to the at least one cathode structure and applying a negative potential to the at least one anode, wherein the electric field is configured to cause the positrons received by the moderator material to drift toward a surface of the moderator material;

establishing a magnetic field throughout the at least one cathode structure and the at least one anode, wherein the magnetic field is perpendicular to the electric field and is configured to cooperate with the electric field to encourage the positrons to drift toward a harvesting area; and extracting the positrons from the harvesting area.

22. The method of claim 21, wherein the at least one anode is spaced apart from the at least one cathode structure so as to define a vacuum gap between the moderator material and the at least one anode, and wherein the magnetic field is configured to cooperate with the electric field to cause the positrons to drift through the vacuum gap toward the harvesting area.

23. The method according to claim 21 further comprising causing emission of electrons toward the positron source, wherein the positron source comprises a converter positioned within the vacuum chamber proximate the at least one cathode structure, wherein the converter is configured to produce positrons upon collision of the electrons with the converter.

24. The method according to claim 21 further comprising causing emission of neutrons toward the at least one cathode structure, wherein the at least one cathode structure is configured to emit gamma-rays upon capture of the neutrons by the at least one cathode structure, and wherein the at least one anode is configured to produce positrons upon collision of the gamma-rays with the at least one anode such that the anode acts as the positron source.

* * * * *